US012172061B2

(12) United States Patent
Pegnatori

(10) Patent No.: US 12,172,061 B2
(45) Date of Patent: Dec. 24, 2024

(54) SHAPED PRE-PREG COMPOSITE LAYER BAT

(71) Applicant: Monsta Athletics, LLC, Claimesa, CA (US)

(72) Inventor: Carl Pegnatori, Calimesa, CA (US)

(73) Assignee: Monsta Athletics, LLC, Calimesa, CA (US)

( * ) Notice: Subject to any disclaimer, the term of this patent is extended or adjusted under 35 U.S.C. 154(b) by 595 days.

(21) Appl. No.: 17/404,961

(22) Filed: Aug. 17, 2021

(65) Prior Publication Data

US 2023/0054351 A1 Feb. 23, 2023

(51) Int. Cl.

| | |
|---|---|
| ***A63B 59/54*** | (2015.01) |
| ***A63B 59/58*** | (2015.01) |
| ***A63B 102/18*** | (2015.01) |

(52) U.S. Cl.

CPC ..... *A63B 59/54* (2015.10); *A63B 59/58* (2015.10); *A63B 2102/182* (2015.10)

(58) Field of Classification Search

CPC .... A63B 2102/182; A63B 59/54; A63B 59/58
USPC ..... 473/564
See application file for complete search history.

(56) References Cited

U.S. PATENT DOCUMENTS

| | | | | |
|---|---|---|---|---|
| 3,876,204 | A * | 4/1975 | Moore | A63B 60/54 473/566 |
| 2003/0195066 | A1* | 10/2003 | Eggiman | A63B 59/50 473/568 |
| 2004/0102303 | A1* | 5/2004 | Kehrle | B31D 3/005 493/463 |
| 2019/0381377 | A1* | 12/2019 | Chauvin | A63B 60/14 |

* cited by examiner

*Primary Examiner* — Jeffrey S Vanderveen
(74) *Attorney, Agent, or Firm* — David B Abel

(57) ABSTRACT

A composite barrel layer for a bat including a fiber pre-preg layer with repetitive folds generally forming part triangle shapes incorporated into a fiber reinforced composite layer of the barrel portion of the bat.

7 Claims, 1 Drawing Sheet

SHAPED PRE-PREG COMPOSITE LAYER BAT

BACKGROUND OF THE INVENTION

1. Field of the Invention

The present invention relates generally to a composite barrel for a bat. More specifically, the composite barrel of the bat includes a fiber pre-preg layer with repetitive folds generally forming part triangle shapes incorporated into the fiber reinforced barrel portion of the bat.

2. Description of Related Art

Composite materials are commonly used for high performance bats in baseball and softball. Composite materials offer some advantages over more traditional materials, such as wood and metal, in terms of targeted strength and weight management. Composite materials may be combined with lightweight metal sleeves to form a double or multiwall bat with improved strength and durability.

Of the materials typically used to construct bats, composite materials allow for the most design flexibility and customization. Composite materials or composites are materials made from two or more individual materials. Composite materials may be formed of fibers embedded in a matrix. For example, a carbon fiber resin matrix composite material is made of carbon fibers embedded within an epoxy resin matrix. The carbon fibers have a high toughness or ability to resist fracture. The use of composite materials allows the bat manufacturer to control the longitudinal stiffness, moment of inertia, mass, and center of gravity of the bat

SUMMARY OF THE INVENTION

The invention generally provides a composite barrel for a bat in which the composite includes a fiber reinforced resin material with the fiber reinforcement formed into a pre-preg layer with repetitive folds generally forming part triangle shapes. A pre-preg is a composite material made from "pre-impregnated" fibers and a partially cured polymer matrix, such as epoxy or phenolic resin, or even thermoplastic mixed with liquid rubbers or resins. The fibers often take the form of a weave and the matrix is used to bond them together and to other components during manufacture. The pre-preg of the present invention is shaped with repetitive folds and then wrapped on a mandrel, and may then be impregnated with additional resin and formed and cured in a mold.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
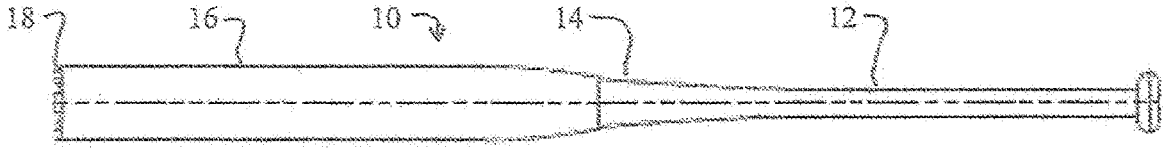
FIG. 1 is a perspective view of an embodiment of a composite bat.

FIG. 1 shows a bat 10 according to an embodiment of the invention. Bat 10 generally includes a handle 12 configured to be grasped by player a tapered section 14, a barrel 16 and an end cap 18. The barrel 16 defines a sweet spot for the preferred area of contacting a ball. The barrel 16 may have a single wall, doublewall or multiwall configuration. At least one wall of the barrel 16 of bat 10 is preferably made from fiber-reinforced composite materials. In some embodiments the handle 12, tapered section and inner or outer walls of the barrel 16 may be made of another material, such as metal, plastics, or the like.

Figure 2:
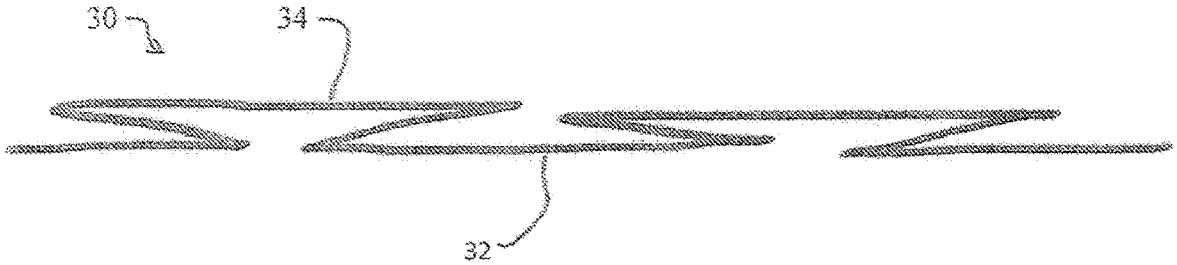
FIG. 2 is an edge view of a fiber pre-preg to be used to form the composite bat of FIG. 1.

FIG. 2 is an edge view of a pre-preg 30 with repetitive folds 32 generally forming part triangle shapes. The pre-preg 30 is a composite material made from "pre-impregnated" fibers and a partially cured polymer matrix, such as epoxy or phenolic resin, or even thermoplastic mixed with liquid rubbers or resins. The fiber sheet is preferably formed of woven carbon fiber. The fibers may take the form of a weave and the matrix is used to bond them together and to other components during manufacture. The pre-preg 30 may be understood as having repeating folds defining upright 32 and inverted 34 part-triangle shapes. The pre-preg 30 is described as defining part-triangle shapes as the triangles are not closed at their apex. The base 36 of each triangle shape is preferably about 0.25 inches to about 1 inch wide, while the sides 38 of the triangle shape are between about one-quarter the width of the base 36 to about one-half the width of the base 36.

The barrel 16 may be made using any standard technique, such as lay up, filament winding, RTF, or the like. In one embodiment, barrel 16 may be made by laying up the pre-preg 30 on a mandrel. The barrel 16 and mandrel may then be heated in an oven until the matrix of the pre-preg 30 cures. The mandrel may then be removed from the barrel 16 leaving the core hollow. In another embodiment, the pre-preg 30 of the barrel 16 may be positioned within a male or female mold. An inflatable member such as a bladder may be disposed within the mold so that when the mold is closed, the bladder may be inflated to press the plies against the mold and to form the hollow core. The mold may then be baked in an oven until the matrix of the pre-preg 30 cures. The mold may then be opened and the bladder deflated and removed from barrel 16. In some embodiments, barrel 16 may be made of a plurality of layers of the pre-preg 30. In some embodiments, each pre-preg 30 may include unidirectional or multidirectional fibers. In some embodiments, barrel 16 may be made of at least one composite layer having the shaped pre-preg 30 and at least one other layer formed from a standard composite or metallic material.

The shaped or folded pre-preg 30 within the barrel 16 of the bat 10 of the present invention provides increased durability. The fibers of the pre-preg 30 are preferably carbon fibers. The repetitive impact of the barrel 16 with softballs or baseballs causes the resin material to partially or locally uncouple from the fibers. Traditional pre-pregs are limited to how much they can flex because there is limited space for the fibers to lex or move upon impact of a ball. The pre-preg 30 of the present invention allows the fibers to break lose from the resin and have additional space to flex or move at impact which increases both performance and durability of the bat.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A bat comprising: a handle portion configured to be grasped by a player, a tapered section and a barrel, wherein the barrel includes at least one layer formed from a shaped pre-preg fiber reinforced composite having a fiber sheet formed into a plurality of repeating folds defining upright and inverted part-triangle shapes, wherein a base of the inverted part triangular shape overlaps each of the sides of the inverted part triangle shape and a portion of a base of the upright part triangle shape whereby the plurality of repeating folds of the pre-preg radially overlap three times over at least one-half of the axial length of the barrel.

2. The bat of claim 1, wherein the pre-preg includes a base of the part triangle shape preferably 0.25 inches to 1 inch wide, and sides of the triangle shape are between one-quarter the width of the base to about one-half the width of the base.

3. The bat of claim 1 wherein the pre-preg is a composite material made from pre-impregnated fibers and a partially cured polymer matrix.

4. The bat of claim 3 wherein the partially cured polymer matrix is an epoxy or phenolic resin.

5. The bat of claim 3 wherein the partially cured polymer matrix is a thermoplastic mixed with liquid rubbers or resins.

6. The bat of claim 1 wherein the fiber sheet is formed of woven carbon fiber.

7. A bat comprising: a handle portion configured to be grasped by a player, a tapered section and a barrel, wherein the barrel includes at least one layer formed from a shaped pre-preg fiber reinforced composite having a fiber sheet formed into a plurality of repeating folds defining upright and inverted part-triangle shapes, wherein a base of the inverted part triangular shape overlaps each of the sides of the inverted part triangle shape and a portion of a base of the upright part triangle shape whereby the plurality of repeating folds of the pre-preg radially overlap three times and the overlapped sections cover between one-half to all of the axial length of the barrel of the bat.

* * * * *